US006899226B2

(12) United States Patent
Voissem

(10) Patent No.: US 6,899,226 B2
(45) Date of Patent: May 31, 2005

(54) REINFORCED BOX WITH ROLL SUSPENSION

(75) Inventor: Ted J. Voissem, Appelton, WI (US)

(73) Assignee: Badger Plug Company, Greenville, WI (US)

( * ) Notice: Subject to any disclaimer, the term of this patent is extended or adjusted under 35 U.S.C. 154(b) by 0 days.

(21) Appl. No.: 10/116,485

(22) Filed: Apr. 3, 2002

(65) Prior Publication Data

US 2003/0188983 A1 Oct. 9, 2003

(51) Int. Cl.[7] ..... B85D 85/66
(52) U.S. Cl. ..... 206/397; 206/389; 211/85.5
(58) Field of Search ..... 206/387, 397; 211/85.5; 242/590, 594.1, 595, 596.8; 312/34.8, 34.9

(56) References Cited

U.S. PATENT DOCUMENTS 1,593,529 A * 7/1926 Gibson et al.
2,674,371 A 4/1954 Blackinton ..... 206/46
3,084,803 A * 4/1963 Bayers
3,317,034 A 5/1967 Bowles et al. ..... 206/46
4,827,818 A * 5/1989 Stringfellow
4,955,505 A * 9/1990 Battaglia
5,069,338 A 12/1991 Grigsby ..... 206/319
5,275,279 A 1/1994 Grigsby ..... 206/319
5,361,900 A 11/1994 Stringer et al. ..... 206/319
5,680,931 A 10/1997 Hashimoto et al. ..... 206/319
5,743,393 A 4/1998 Webb et al. ..... 206/319
5,758,818 A 6/1998 Ewing, Jr. ..... 229/120.011
5,944,280 A * 8/1999 Dimitri

* cited by examiner

*Primary Examiner*—David T. Fidei
(74) *Attorney, Agent, or Firm*—Donald S. Dowden; Cooper & Dunham LLP

(57) ABSTRACT

A container for goods having an axial dimension has a pair of supports spaced apart axially relative to the goods for supporting the goods. A reinforcement extends between the supports and is connected to each of the supports at at least four spaced-apart locations. The locations are selected so that a first imaginary planar surface connects a first two of the locations on one of the supports to a first two of the locations on the other of the supports, and a second imaginary planar surface connects a second two of the locations on one of the supports to a second two of the locations on the other of the supports. The two imaginary surfaces form a dihedral angle within the range of 10 to 60 degrees opening towards the top side of the container. Even if it has no top and bottom walls, the container is triangulated and quite rigid.

19 Claims, 4 Drawing Sheets

REINFORCED BOX WITH ROLL SUSPENSION

BACKGROUND OF THE INVENTION

1. Field of the Invention

This invention relates to boxes and, more particularly, to a novel and highly effective reinforced box for storing and shipping a variety of goods.

2. Description of the Prior Art

Paper, metal, plastic and cloth for various uses are often shipped in rolls. The rolls are often provided with core plugs that extend into opposite ends of cylindrical cores around which the rolls are respectively wound. The plugs, if provided, and otherwise the cylindrical cores around which the rolls are wound, extend out from the rolls so that they can engage supports, such as opposite walls of a shipping container, that suspend the rolls. The supports are incorporated in containers in which the rolls can be kept in inventory or shipped. The rolls may weigh from less than 100 pounds to in excess of 1,000 pounds or even in excess of a ton.

The following patents give an indication of the development of the art up to the present:

| Inventor(s) | Patent No. | Title |
|---|---|---|
| Blackinton | 2,674,371 | Jet Motor Container |
| Bowles et al. | 3,317,034 | Reinforced Carton |
| Grigsby | 5,069,338 | Support Pad and a Pallet with Sockets for a Wood Reinforced Corrugated Paperboard Shipping Container |
| Grigsby | 5,275,279 | Shipping Container for an Outboard Motor |
| Stringer et al. | 5,361,900 | Compressor Shipping Carton |
| Hashimoto et al. | 5,680,931 | Outboard Motor Packing Structure Convertible to Display Stand |
| Webb et al. | 5,743,393 | Protective Package for Heavy Objects |
| Ewing, Jr. | 5,758,818 | Dividable Multi-Compartment Container |

The patents listed above disclose various solutions to the problem of shipping a variety of goods, including heavy goods having a generally cylindrical shape. The Ewing patent discloses a container having a divider.

The solutions disclosed in those patents are generally complicated and expensive to implement.

OBJECTS AND SUMMARY OF THE INVENTION

An object of the invention is to provide a container that is better adapted than containers of the prior art for storing and shipping a variety of goods including heavy rolls of paper, metal, plastic or cloth, and at the same time less expensive to manufacture.

The foregoing and other objects are attained in accordance with the invention by providing a container for goods, such as one or more rolls, having an axial dimension. The container comprises a pair of supports spaced apart axially relative to the goods for supporting the goods and a reinforcement extending between the supports and connected to each of the supports at at least four spaced-apart locations. The locations are selected so that a first imaginary planar surface connects a first two of the locations on one of the supports to a first two of the locations on the other of the supports. A second imaginary planar surface connects a second two of the locations on one of the supports to a second two of the locations on the other of the supports. The two imaginary surfaces form a dihedral angle within the range of 10 to 60 degrees. Preferably, the range is 20 to 40 degrees, and ideally the angle is substantially 30 degrees. From another standpoint, the container comprises a pair of walls axially spaced apart relative to the goods for supporting the goods and a reinforcement connected to and extending between the walls and comprising first and second sloping portions.

In accordance with an independent aspect of the invention, such a container and a roll of goods are provided in combination.

In accordance with another independent aspect of the invention, a method of shipping a heavy roll of goods comprises providing such a container, suspending one or more rolls within it, and shipping the combination.

BRIEF DESCRIPTION OF THE FIGURES OF THE DRAWING

A better understanding of objects, features and advantages of the invention can be gained from the following detailed description of the preferred embodiments thereof, in conjunction with the appended figures of the drawing, wherein.

DESCRIPTION OF THE PREFERRED EMBODIMENTS

Figure 1:
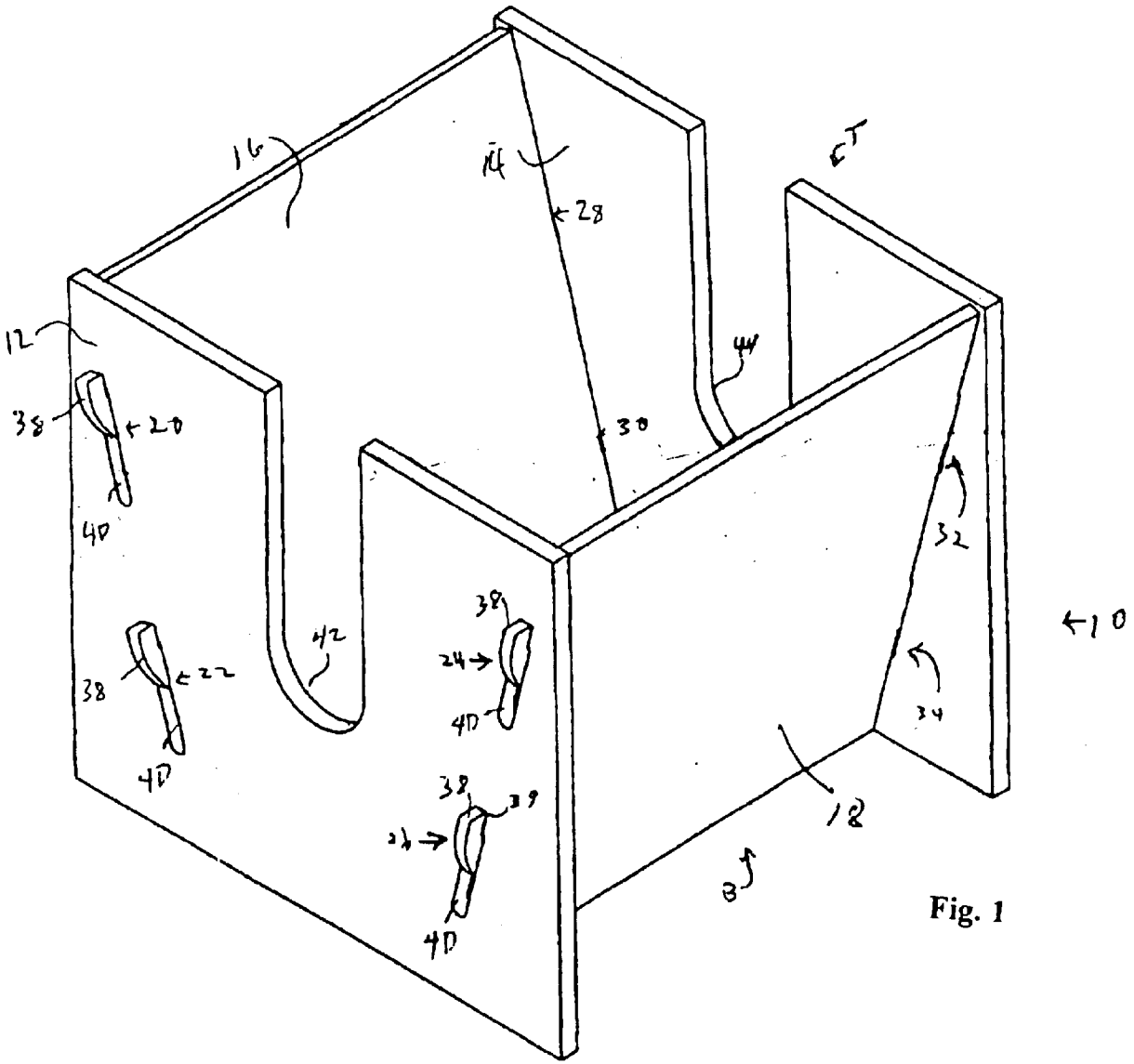
FIG. 1 is a perspective view of a container constructed in accordance with the invention.
Figure 3:
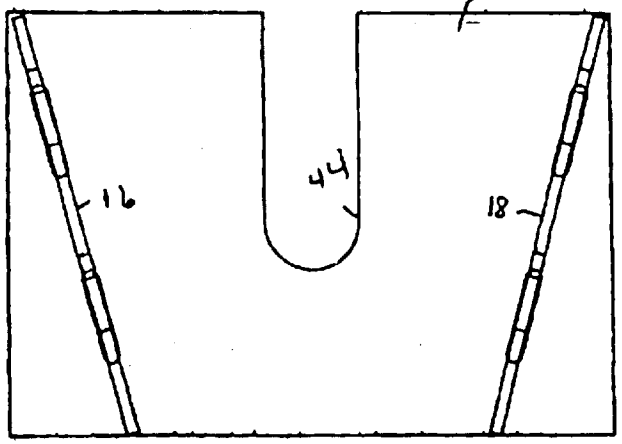
FIG. 3 is a sectional view in front elevation.
Figure 2:
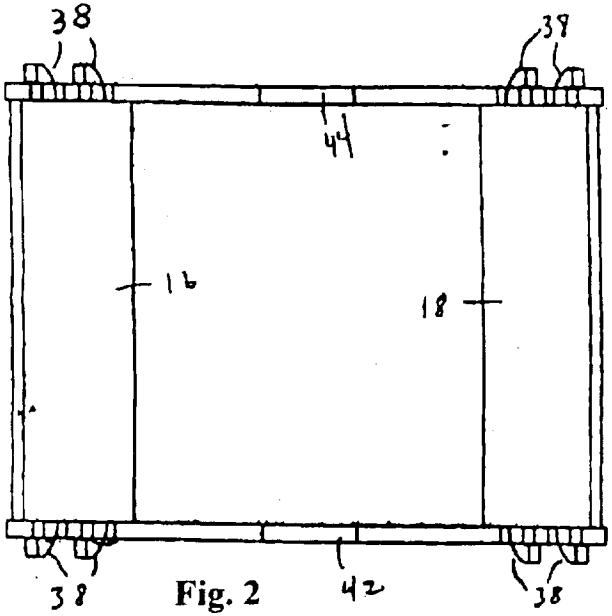
FIG. 2 is a top plan view thereof.
Figure 5:
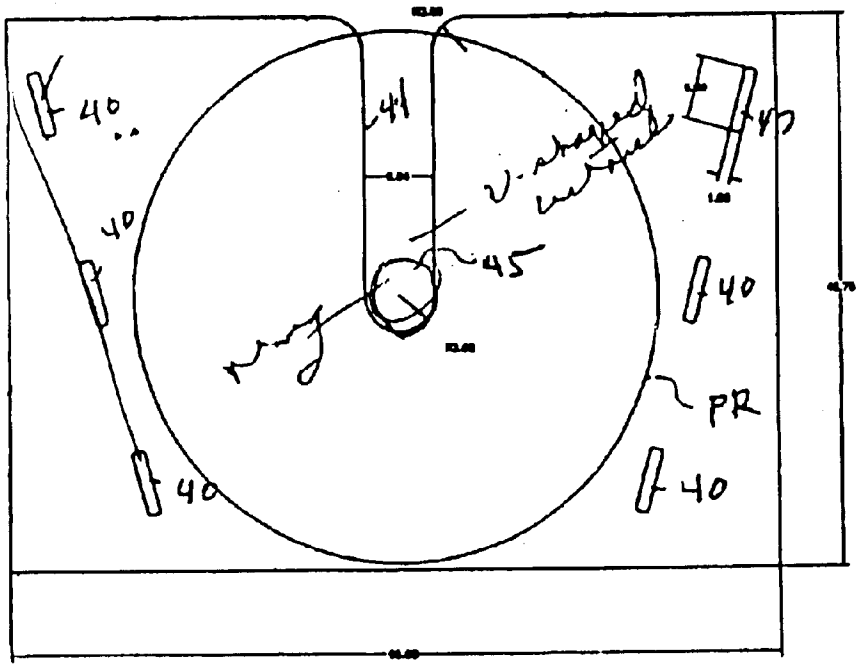
FIG. 5 is a sectional view in front elevation of another embodiment of the invention, showing a suspended roll.

FIG. 1 is a perspective view of apparatus 10 constructed in accordance with the invention. The apparatus 10 is a container that comprises a pair of supports 12 and 14 for supporting goods such as a roll of paper, metal, plastic or cloth. The paper roll PR shown in FIG. 5 is intended to represent any such goods. The supports 12 and 14 are spaced apart axially relative to the goods.

Figure 8:
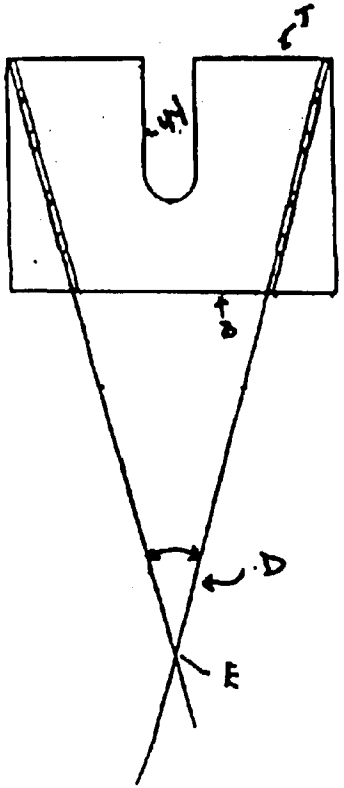
FIG. 8 is a schematic view in front elevation illustrating the dihedral angle formed by two imaginary surfaces in accordance with the invention.

A reinforcement comprising boards 16 and 18 extends between the supports. The reinforcement is connected to each of the supports at at least four spaced-apart locations. In FIG. 1, the four locations on the support 12 are 20, 22, 24 and 26. There are four other such locations 28, 30, 32 and 34 associated with the support 14. The locations are selected so that a first imaginary planar surface coincident with one of the reinforcing boards, for example the board 16, connects a first two of the locations, such as 20 and 22 on one of the supports (the support 12 in this example), to a first two of the locations, such as 28 and 30 on the other of the supports (the support 14 in this example). In the same way, a second imaginary planar surface coincident with the other of the reinforcing boards, for example the board 18, connects a second two of the locations, such as 24 and 26 on one of the supports (the support 12 in this example), to a second two of the locations, such as 32 and 34 on other of the supports (the support 14 in this example). The two imaginary surfaces form a dihedral angle D (FIG. 8) within the range of 10 to 60 degrees opening towards the top T of the container. Preferably, the range is 20 to 40 degrees, and the ideal value is substantially 30 degrees. Relative to a vertical plane bisecting the angle D, the angles formed by the reinforcing boards are, of course, half the values indicated above: namely, plus and minus 5 to 30 degrees; plus and minus 10 to 20 degrees; and plus and minus 15 degrees, respectively.

Both the supports 12 and 14 and the reinforcement 16, 18 can be made of inexpensive material such as plywood, particle board, wafer board, plastic or ferrous or nonferrous metal.

A container in accordance with the invention lends itself to storing and shipping a variety of goods, particularly cylindrical goods such as rolls of paper, metal, plastic or cloth. Such rolls can be very heavy and are notoriously difficult to ship. The containers employed for their shipment must have considerable strength but should not be excessively heavy themselves. One problem of transporting heavy goods secured with the aid of strapping is that the strapping may break or the package may become otherwise destabilized.

Figure 4:
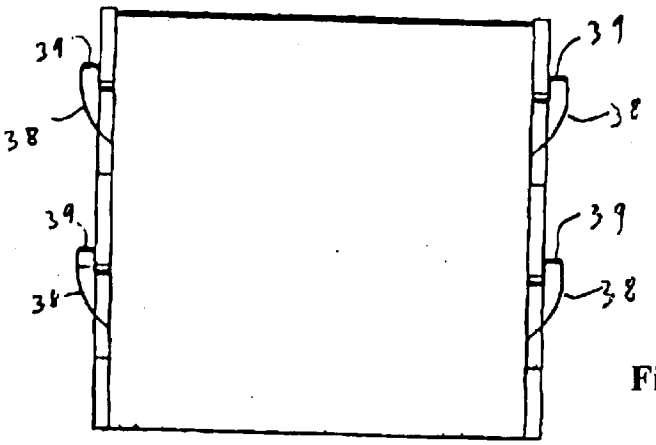
FIG. 4 is a side elevational view of a reinforcing board employed in apparatus of FIG. 1.

The reinforcing boards of the invention address this problem. They include tabs or hooks 38 (FIG. 4) that fit into and interlock removably with slots 40 at each of the locations 20, 22, 24, 26, 28, 30, 32 and 34. The tabs or hooks 38 have upwardly directed tails 39, well shown in FIGS. 4 and 6. When the reinforcement is mounted, the tails 39 extend on the outside of the respective walls 12 and 14 beyond the slots 40 in the upward direction. Since the rolls are supported by the walls 12 and 14, the weight of the rolls tends to lock the reinforcing boards 16 and 18, once correctly positioned, securely in place. The tabs or hooks 38 counter any outwardly directed force acting on the walls 12 and 14 by developing a tension force within the reinforcement 16, 18. Since the reinforcing boards 16 and 18 resist tension forces very strongly, they greatly strengthen and stabilize the container 10 against the possibility that the contained roll will become unmoored.

The sloped mounting of the boards 16 and 18 as disclosed herein imparts a triangulated structure to the container 10, while not unduly limiting its interior storage volume. With merely vertical walls and strapping and without the sloping reinforcing boards 16 and 18, the container 10 has less than ideal stability. Such a container benefits from additional structure, such as a top or bottom wall, for added rigidity. In accordance with the invention, the container, even if it has no top or bottom wall (i.e., it is open at the top and bottom), cannot be collapsed so long as the four provided walls do not rupture.

Figure 9:
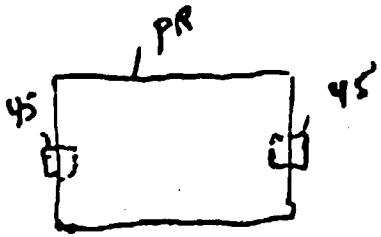
FIG. 9 is a view in side elevation showing a roll of goods and a pair of plugs respectively engaged with the roll at axially spaced-apart locations and engageable with openings formed in the container.
Figure 10:
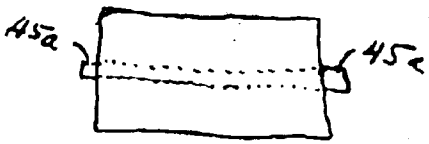
FIG. 10 is a view similar to FIG. 9, but showing an extended core instead of core plugs.
Figure 7:
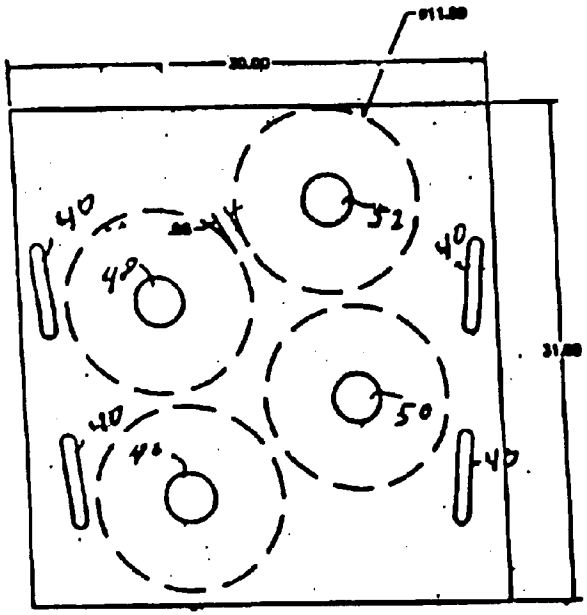
FIG. 7 is a view in front elevation of a container constructed to hold a plurality of rolls.

The core plugs such as plugs 45 (FIGS. 5 and 9) or core extensions 45*a* (FIGS. 5 and 10) can be suspended in U-slots 42, 44, as in FIGS. 1–3, 5 and 8, or in through-holes 46, 48, 50, 52, as in FIG. 7.

Preferably, the tabs 38 are formed on the reinforcement boards 16 and 18, and the slots 40 are formed in the end walls 12 and 14. However, it is within the scope of the invention to form tabs on the walls 12 and 14 and slots in the reinforcement boards 16 and 18.

The container has a top side T and a bottom side B, and the dihedron (FIG. 8) opens towards the top side T. The imaginary edge E is below the bottom side B a distance that depends on the value of the angle and the separation between the reinforcing boards 16 and 18.

The roll or rolls are mounted so that its axis or their axes are parallel to the edge E of the dihedron. If the container is designed to suspend only one roll, the roll is mounted so that an imaginary plane containing its axis and the edge E bisects the dihedron.

Figure 6:
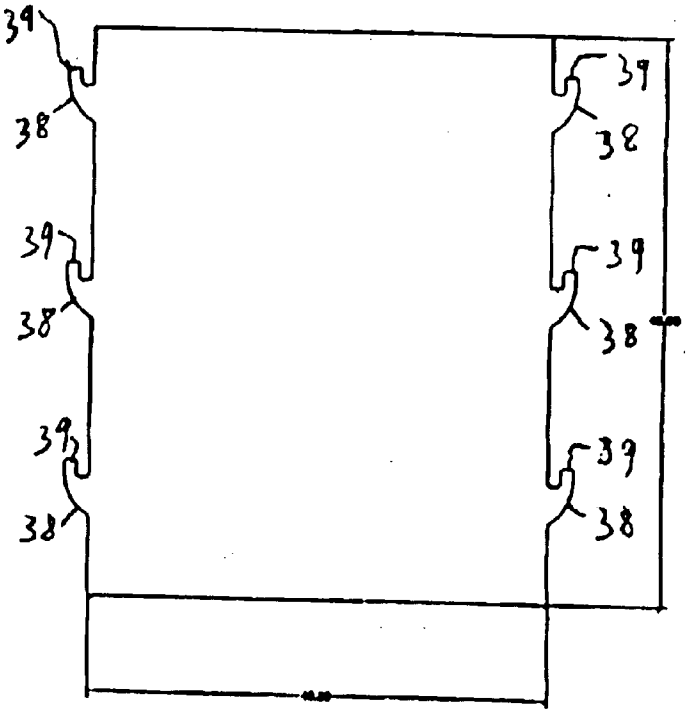
FIG. 6 is a view in side elevation of a reinforcing board employed in apparatus of FIG. 5.

In the embodiment of FIGS. 5 and 6, there are six tab-receiving slots 40 on each support (twelve slots altogether) and six tabs 38 on each reinforcing board (twelve tabs altogether). The number of slots and tabs can be varied, as those skilled in the art will readily understand. Also, means other than slots and tabs can be used to connect the supports to the reinforcement. A single tab-and-slot connection or other joining means can be elongated so that it encompasses a plurality of the "spaced-apart locations" mentioned above. Thus all that is necessary for the container for axially elongated goods is a pair of walls axially spaced apart relative to the goods for supporting the goods and a reinforcement connected to and extending between the walls and comprising first and second sloping portions forming a dihedral angle within a range of 10 to 60 degrees.

Thus there is provided in accordance with the invention a novel and highly effective reinforced box for storing and shipping heavy goods such as large rolls of paper. The invention provides a container that is better adapted than containers of the prior art for storing and shipping heavy goods such as rolls of paper, metal, plastic or cloth and at the same time less expensive to manufacture, especially since only four walls are necessary to form a rigid container.

Many modifications of the preferred embodiments of the invention disclosed herein will readily occur to those skilled in the art upon the consideration of this disclosure. The invention is to be construed as covering all embodiments thereof that fall within the scope of appended claims.

I claim:

1. A container for goods having an axial dimension, a top side and a bottom side, the container comprising:

a pair of supports spaced apart axially relative to the goods for supporting the goods; and a reinforcement extending between the supports and removably connect to each of the supports at least four spaced-apart locations, the locations being selected so that a first imaginary planar surface connects a first two of the locations on one of the supports to a first two of the locations on the other of the supports, a second imaginary planar surface connects a second two of the locations on one of the supports to a second two of the locations on the other of the supports, and the two imaginary surfaces form a dihedral angle within the range of 10 to 60 degrees opening towards the top side of the container.

2. A container according to claim 1 further comprising the goods, wherein the goods comprise at least one roll coiled about an axis.

3. A container for goods having an axial dimension, a top side and a bottom side, the container comprising:

a pair of supports spaced apart axially relative to the goods for supporting the goods; and a reinforcement extending between the supports and connected to each of the supports at at least four spaced-apart locations, the locations being selected so that a first imaginary planar surface connects a first two of the locations on one of the supports to a first two of the locations on the other of the supports, a second imaginary planar surface connects a second two of the locations on one of the supports to a second two of the locations on the other of the supports, and the two imaginary surfaces form a dihedral angle within the range of 10 to 60 degrees opening towards the top side of the container;

further comprising the goods, wherein the goods comprise a plurality of rolls respectively coiled about separate axes, the rolls being supported so that the axes are parallel.

4. A container according to claim 2 wherein the roll weighs in excess of 1,000 pounds.

5. A container according to claim 2 wherein the roll weighs in excess of a ton.

6. A container according to claim 1 wherein the supports respectively comprise walls that are parallel to each other.

7. A container for goods having an axial dimension, a top side and a bottom side, the container comprising:

a pair of supports spaced apart axially relative to the goods for supporting the goods; and a reinforcement extending between the supports and connected to each of the supports at at least four spaced-apart locations, the locations being selected so that a first imaginary planar surface connects a first two of the locations on one of the supports to a first two of the locations on the other of the supports, a second imaginary planar surface connects a second two of the locations on one of the supports to a second two of the locations on the other of the supports, and the two imaginary surfaces form a dihedral angle within the range of 10 to 60 degrees opening towards the top side of the container;

wherein the supports respectively comprise walls that are parallel to each other; and wherein each of the walls is formed with an opening, further comprising connecting means connecting the goods to the walls, the connecting means comprising (a) a pair of plugs respectively engageable with the goods at axially spaced apart locations of the goods and respectively engageable within the openings or (b) a pair of cores extending from the goods at axially spaced apart locations of the goods and respectively engageable within the openings.

8. A container according to claim 1 wherein the reinforcement comprises a pair of substantially planar reinforcing plates, one of the plates lying substantially in the first imaginary planar surface and the other of the plates lying substantially in the second imaginary planar surface.

9. A container for goods having an axial dimension, the container comprising:

a pair of supports spaced apart axially relative to the goods for supporting the goods; and a reinforcement extending between the supports and connected to each of the supports at at least four spaced-apart locations, the locations being selected so that a first imaginary planar surface connects a first two of the locations on one of the supports to a first two of the locations on the other of the supports, a second imaginary planar surface connects a second two of the locations on one of the supports to a second two of the locations on the other of the supports, and the two imaginary surfaces form a dihedral angle within the range of 10 to 60 degrees;

further comprising, at each of the locations, a removably interlocking tab and slot, one of the tab and slot being formed on one of the support and reinforcement and the other of the tab and slot being formed on the other of the support and reinforcement.

10. A container according to claim 9 wherein, at at least one of the locations, the tab is formed on the reinforcement and the slot is formed on the support.

11. A container according to claim 9 wherein, at each of the locations, the tab is formed on the reinforcement and the slot is formed on the support.

12. A container according to claim 1 wherein the angle is within the range of 20 to 40 degrees.

13. A container according to claim 1 wherein the angle is substantially 30 degrees.

14. A container according to claim 1 that is open at the top and bottom sides.

15. A container for axially elongate goods, the container having a top side and a bottom side and comprising:

a pair of walls axially spaced apart relative to the goods for supporting goods; and a reinforcement removably connected to and extending between the walls and comprising first and second sloping portions respectively lying in first and second imaginary planes forming a dihedral angle within the range of 10 to 60 degrees and opening towards the top side of the container.

16. A container according to claim 15 wherein the first and second sloping portions respectively comprise first and second boards.

17. A container according to claim 16 wherein the boards comprise a material selected from the group consisting of plywood, particle board, wafer board, plastic, ferrous metal and nonferrous metal.

18. A combination comprising:

at least one roll of goods selected from the group consisting of paper, metal, plastic and cloth coiled about an axis and weighing in excess of a ton; and a container for the roll, the container having a top side and a bottom side and comprising:

a pair of walls parallel to each other and spaced apart axially relative to the roll for supporting the roll; and a pair of substantially planar reinforcing plates extending between the walls and connected to each of the walls at at least four spaced-apart locations, the locations being selected so that the plates lie respectively in imaginary planes that intersect at an edge and form a dihedral angle with each other of substantially 30 degrees opening top side of the container, the roll being mounted so that its axis is parallel to the edge, and an imaginary plane containing its axis and the edge bisects the angle;

wherein each of the walls is formed with an opening, further comprising means selected from the group consisting of (a) a pair of plugs respectively engageable with the roll at axially spaced apart locations of the roll and respectively engageable within the openings and (b) a pair of core extensions respectively extending from the roll at axially spaced apart locations of the roll and respectively engageable within the openings.

19. A shipping method comprising:

providing at least one roll of goods selected from the group consisting of paper, metal, plastic and cloth coiled about an axis and weighing in excess of a ton;

providing a container for the roll, the container having a top side and a bottom side and comprising a pair of walls parallel to each other and spaced apart axially relative to the roll for supporting the roll and a pair of substantially planar reinforcing plates extending between the walls and connected to each of the walls at at least four spaced-apart locations;

selecting the locations so that the plates lie respectively in imaginary planes that intersect at an edge and form a dihedral angle with each other of substantially 30 degrees opening towards the top side of the container;

mounting the roll so that its axis is parallel to the edge, and an imaginary plane containing its axis and the edge bisects the angle;

forming an opening in each of the walls, providing means selected from the group consisting of (a) a pair of plugs respectively engageable with the roll at axially spaced apart locations of the roll and respectively engageable within the openings and (b) a pair of core extensions respectively extending from the roll at axially spaced apart locations of the roll and respectively engageable within the openings; and shipping the roll in the container.

* * * * *